US008251551B2

(12) United States Patent
Zheng

(10) Patent No.: US 8,251,551 B2
(45) **Date of Patent: *Aug. 28, 2012**

(54) LED LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 261 days.

This patent is subject to a terminal disclaimer.

(21) Appl. No.: 12/775,495

(22) Filed: May 7, 2010

(65) Prior Publication Data

US 2011/0103078 A1 May 5, 2011

(30) Foreign Application Priority Data

Oct. 30, 2009 (CN) ..... 2009 1 0309155

(51) Int. Cl.
*F21V 29/00* (2006.01)

(52) U.S. Cl. ..... 362/362; 362/267; 362/431

(58) Field of Classification Search ..... 362/153, 362/240, 249.02, 267, 362, 375, 431
See application file for complete search history.

(56) References Cited

U.S. PATENT DOCUMENTS

| | | | | |
|---|---|---|---|---|
| 7,637,638 | B2 * | 12/2009 | Chen | 362/267 |
| 7,758,223 | B2 * | 7/2010 | Osawa et al. | 362/240 |
| 7,766,512 | B2 * | 8/2010 | Chou et al. | 362/249.02 |
| 8,021,027 | B2 * | 9/2011 | Galipeau et al. | 362/431 |
| 8,083,381 | B2 * | 12/2011 | Tsai | 362/249.02 |
| 8,109,657 | B2 * | 2/2012 | Huang et al. | 362/249.02 |
| 2008/0130266 | A1 * | 6/2008 | DeWitt et al. | 362/362 |

* cited by examiner

*Primary Examiner* — Y My Quach Lee
(74) *Attorney, Agent, or Firm* — Altis Law Group, Inc.

(57) ABSTRACT

An LED lamp includes a planar base, an LED module mounted on the base, an envelope covering the LED module, and a lamp housing having a configuration like a lantern and defining a cavity. An annular receiving groove is recessed from a bottom face of the base. The LED module is attached on the bottom face of the base and surrounded by the receiving groove. The envelope includes a recessed body and an engaging flange extending outwardly from a periphery of the body. The engaging flange of the envelope is received in the receiving groove. The base, the LED module and the envelope are received in the cavity.

16 Claims, 5 Drawing Sheets

LED LAMP

BACKGROUND

1. Technical Field

The disclosure relates to illumination devices and, particularly, to an LED (light-emitting diode) lamp having a good waterproof performance.

2. Description of Related Art

LEDs are well known solid state light sources, in which current flows in a forward direction through a junction of two different semiconductors. Electrons and cavities combine at the junction to generate light. LEDs provide advantages of resistance to shock and practically limitless lifetime under specific conditions. When deployed in a lamp, LEDs offer a cost-effective yet high quality alternative to incandescent and fluorescent fixtures.

When the LED lamp is used outdoors for illumination, dust and moisture may enter the LED lamp, causing current leakage or short circuit, or contamination of the LEDs.

What is needed, therefore, is an LED lamp which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
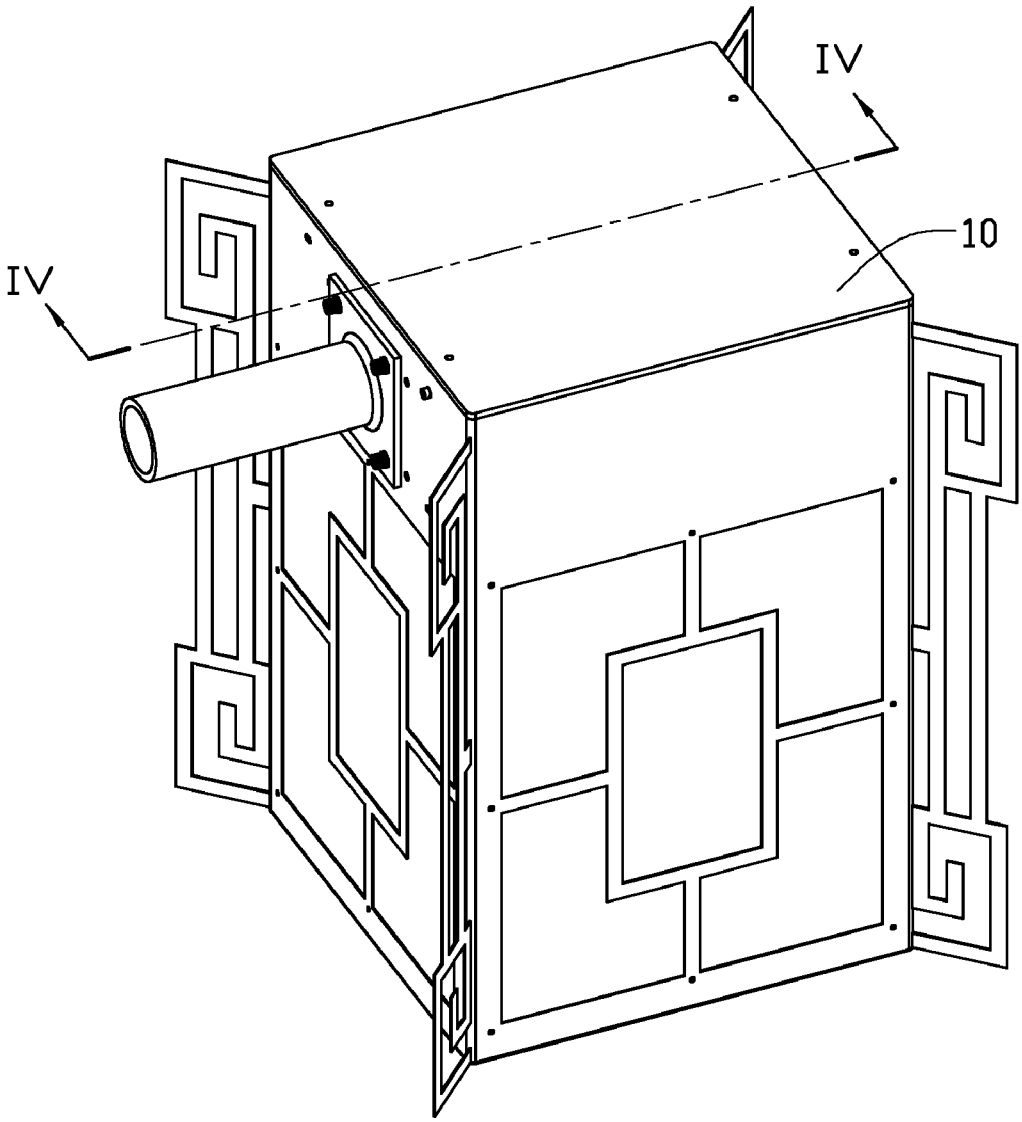
FIG. 1 is an isometric, assembled view of an LED lamp in accordance with a first embodiment of the disclosure.
Figure 2:
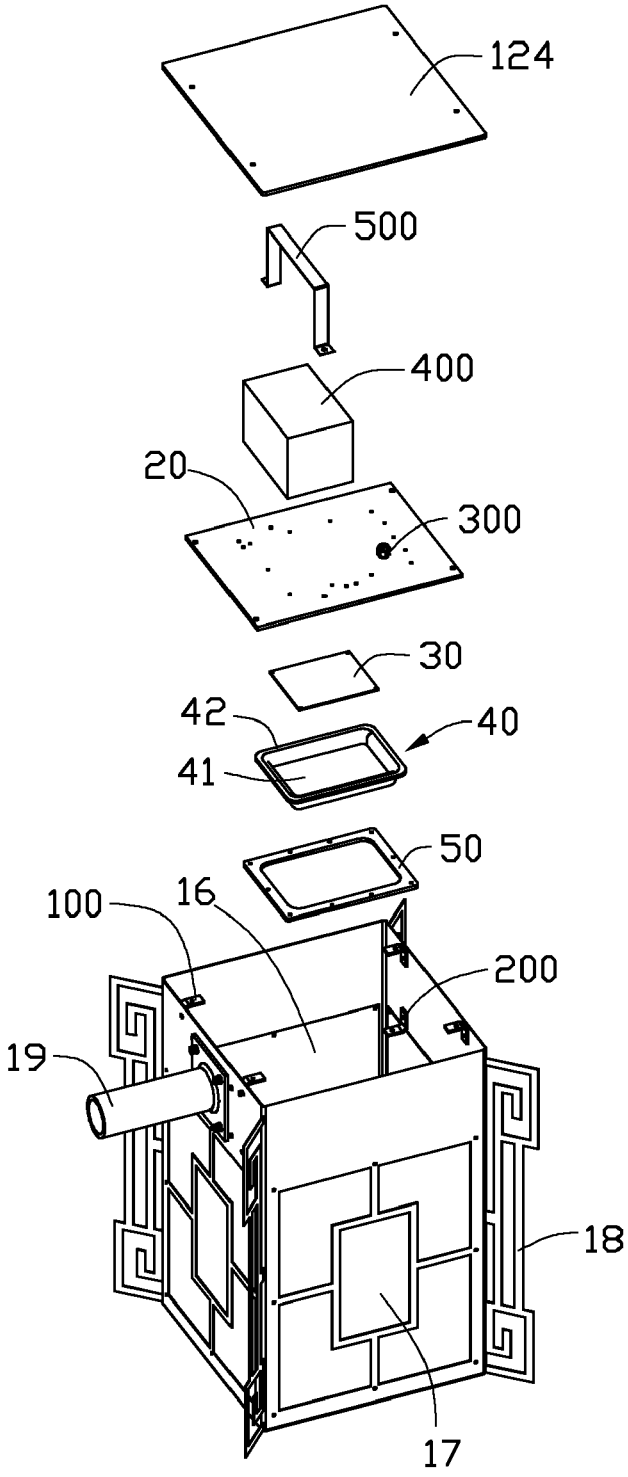
FIG. 2 is an exploded view of the LED lamp of FIG. 1.

Referring to FIGS. 1 and 2, an LED lamp in accordance with a first embodiment of the disclosure can be applied outdoors for illumination and has a good waterproof performance. The LED lamp comprises a hollow lamp housing 10, a base 20 received in the lamp housing 10, an LED module 30 mounted on the base 20, and a transparent envelope 40 mounted on the base 20 and correspondingly covering the LED module 30.

Figure 3:
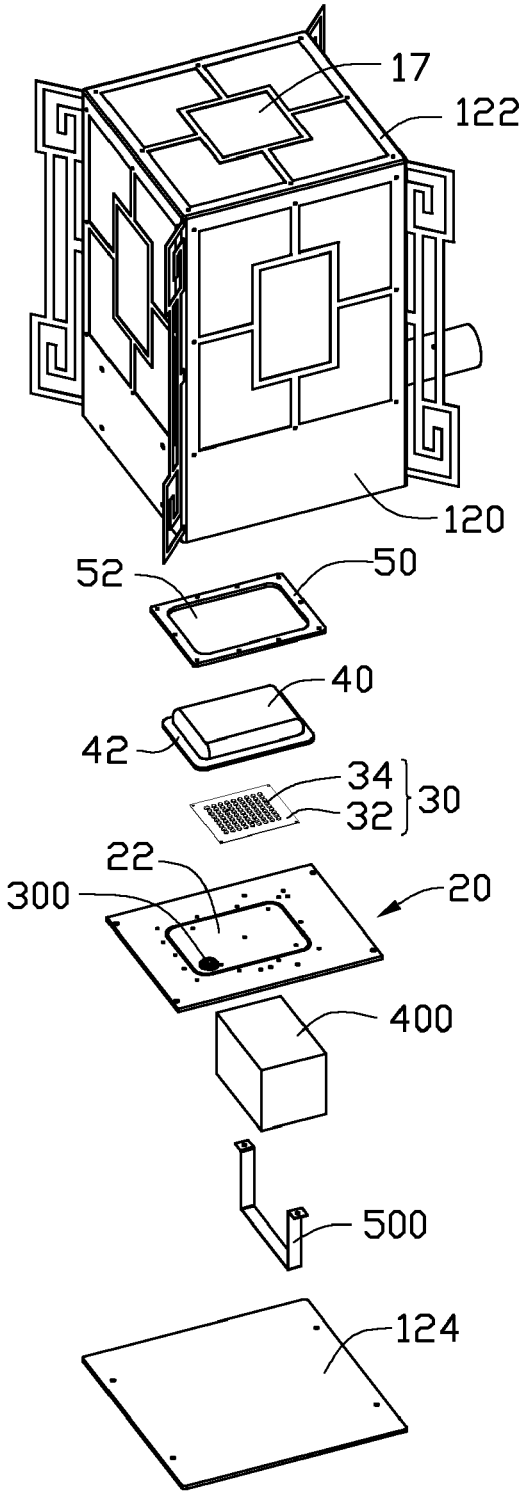
FIG. 3 is an inverted, exploded view of the LED lamp of FIG. 1.
Figure 4:
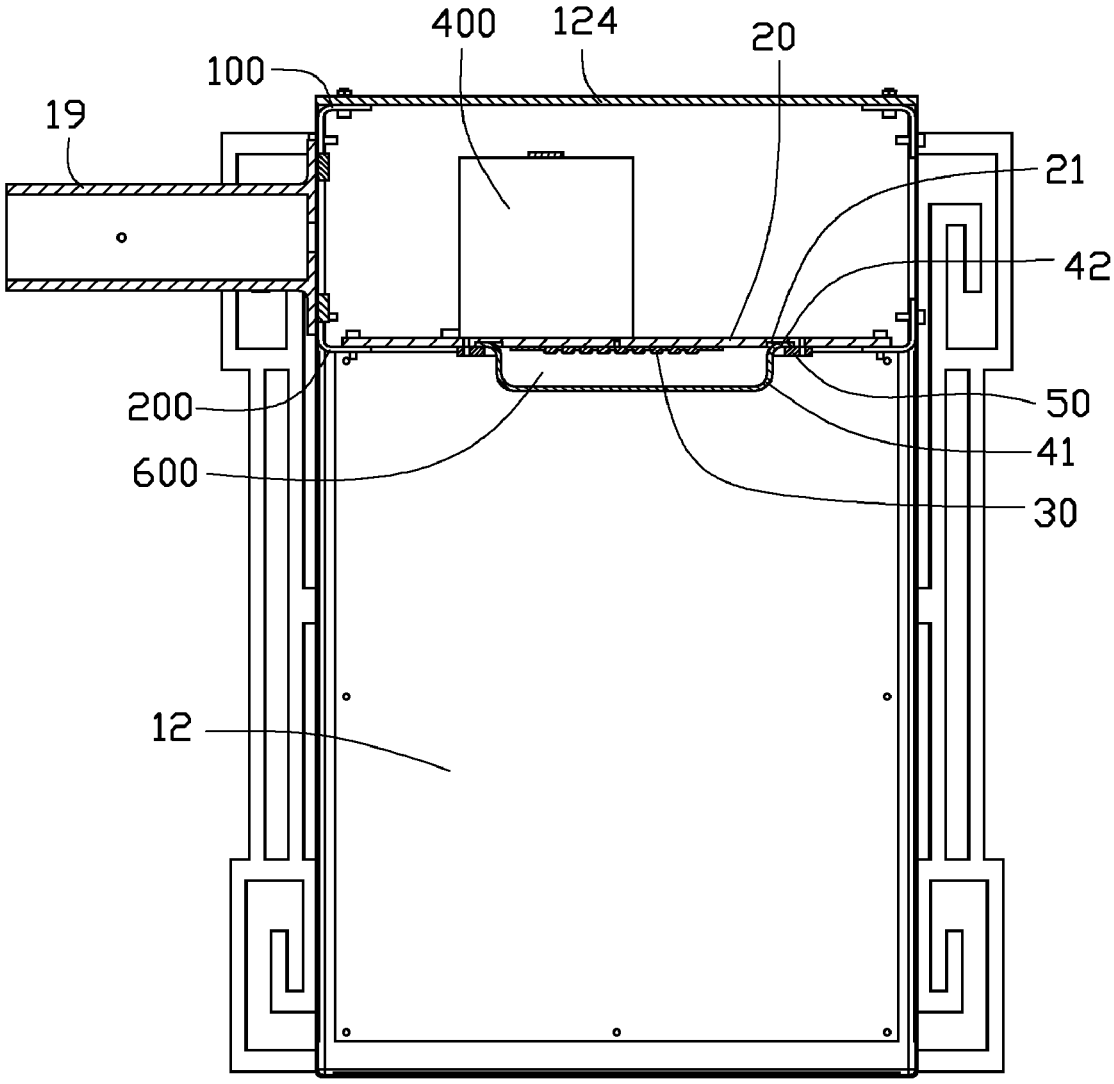
FIG. 4 is a cross-sectional view of the LED lamp of FIG. 1, taken along a line IV-IV thereof.

Referring to FIGS. 3 and 4 also, the lamp housing 10 has a configuration like a rectangular lantern and defines a cavity 12 inside the lamp housing 10. The lamp housing 10 is cuboid-shaped and comprises four upright lateral plates 120, a bottom plate 122 and a cover plate 124. The four lateral plates 120 and the bottom plate 122 are both hollowed out. The hollow-out four lateral plates 120 and bottom plate 122 each define a light-emergent window 17, for light emitted by the LED module 30 radiating out of the lamp. Five transparent boards 16 are further provided to the lamp housing 10 and secured to the four lateral plates 120 and the bottom plate 122, respectively. The transparent boards 16 correspondingly cover the light-emergent windows 17, respectively. The transparent boards 16 are disposed in the cavity 12 inside the lamp housing 10. Four hollow-out decorated brackets 18 extend outwardly and diagonally from joints of every two adjacent lateral plates 120, respectively.

Four spaced first mounting members 100 are further provided to the lamp housing 10. Each of the first mounting members 100 is L-shaped and comprises a first arm (not labeled) and a second arm (not labeled) perpendicularly extending from the first arm. The first arms of the first mounting members 100 are securely attached to inner faces of the lateral plates 120, and the second arms of the first mounting members 100 are coplanar and located at top ends of the lateral plates 120. The cover plate 124 is fixed on the second arms of the four first mounting members 100. Four spaced second mounting members 200 are further provided to the lamp housing 10. Each second mounting member 200 is located just below a corresponding first mounting member 100. Each of the second mounting members 200 is L-shaped and comprises a third arm (not labeled) and a forth arm (not labeled) perpendicularly extending from the third arm. The third arms of the second mounting members 200 are securely attached to the inner faces of the lateral plates 120, and the forth arms of the second mounting members 200 are coplanar and located adjacent to top ends of the transparent boards 16. The base 20 is fixed on and supported by the forth arms of the four second mounting members 200, whereby the base 20 is securely received in the cavity 12 of the lamp housing 10.

The base 20 is integrally made of a metal with good heat conductivity such as aluminum, copper or an alloy thereof. The base 20 is a rectangular plate. An annular receiving groove 21 is defined on a bottom face of the base 20. A rectangular mounting portion 22 is formed at a central area of the base 20 and surrounded by the receiving groove 21. The LED module 30 is thermally attached on the mounting portion 22. A through hole (not labeled) is defined at a corner of the mounting portion 22 of the base 20. A waterproof connecter 300 is further provided to the LED lamp and inserted into the through hole of the base 20, for allowing electrical wires to extend therethrough to connect the LED module 30 with a driving module 400. Additionally, the driving module 400 is fixed by a U-shaped fixing bracket 500 on a top face of the base 20.

The LED module 30 comprises a rectangular printed circuit board 32 and a plurality of LEDs 34 mounted on the printed circuit board 32. The printed circuit board 32 is attached on the mounting portion 22 of the base 20. The LEDs 34 are arranged evenly on the printed circuit board 32 and spaced from each other.

The envelope 40 is integrally formed of a transparent or semitransparent material such as glass, resin or plastic. The envelope 40 comprises a recessed body 41 and an engaging flange 42 extending outwardly and horizontally from a periphery of the body 41. The engaging flange 42 of the envelope 40 has a size substantially the same as that of the receiving groove 21 of the base 20, whereby the engaging flange 42 is fittingly received in the receiving groove 21. When the envelope 40 is assembled to the base 20, a bottom face of the engaging flange 42 is coplanar with the bottom face of the base 20. The envelope 40 is mounted on the bottom face of the base 20 with the engaging flange 42 of the envelope 40 received in the receiving groove 21, so that the envelope 40 is hermetically connected to the base 20 and a receiving chamber 600 for accommodating the LED module 30 is cooperatively defined between the base 20 and the envelope 40.

A pressing frame 50 is further provided to the LED lamp for securing the envelope 40 to the base 20. The pressing frame 50 is substantially rectangular, loop-shaped. The pressing frame 50 defines a hole 52 at a center thereof. The hole 52 has a size larger than that of the body 41 of the envelope 40 but smaller than that of the engaging flange 42 of the envelope 40, so that the body 41 can extend through the pressing frame 50, and the engaging flange 42 can be pressed by the pressing frame 50 towards the base 20 when screws (not shown) are used to extend through the pressing frame 50 and threadedly engage in the bottom face of the base 20. In other words, the engaging flange 42 of the envelope 40 is sandwiched between the pressing frame 50 and the base 20.

Figure 5:
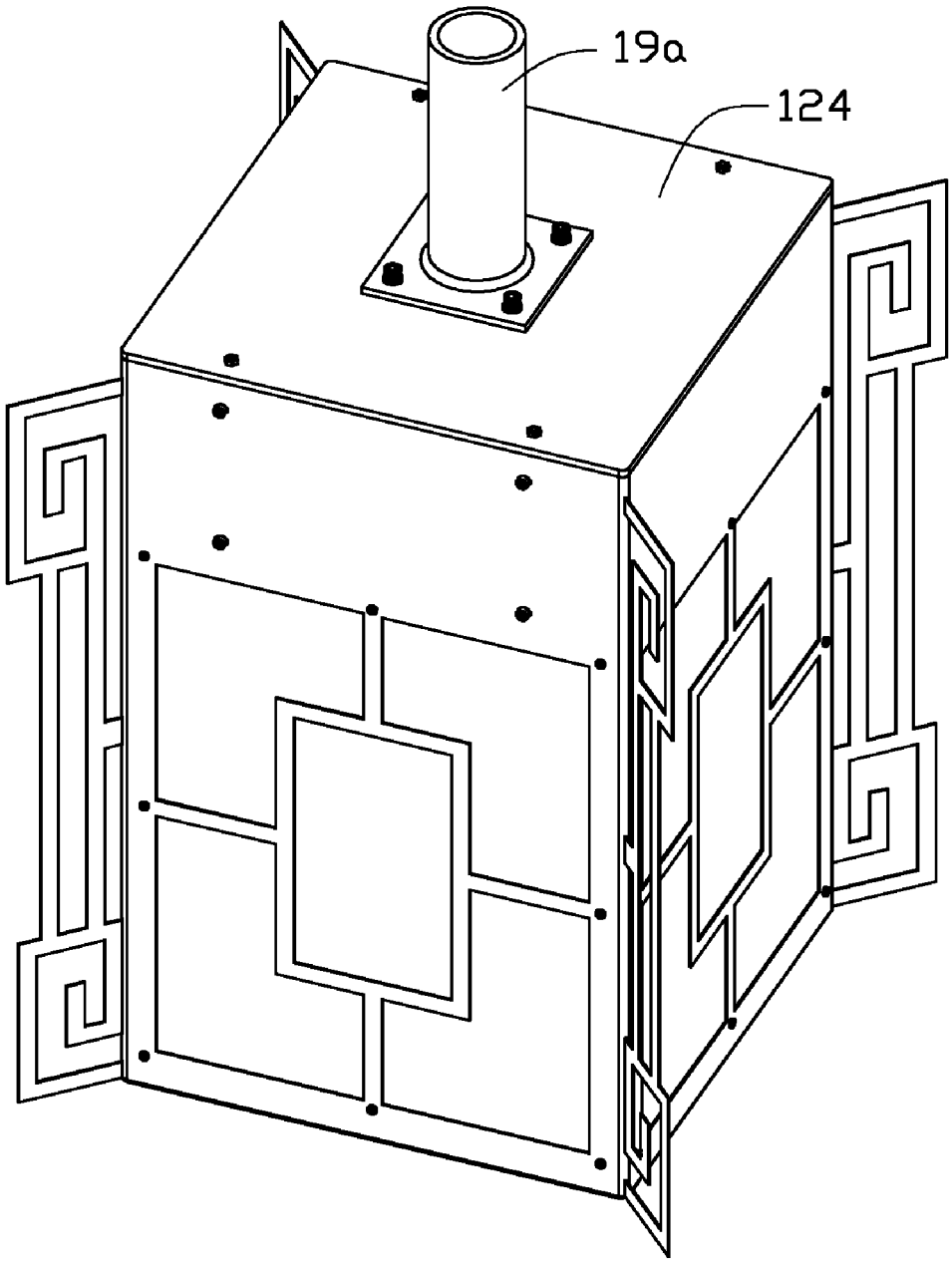
FIG. 5 is an isometric, assembled view of an LED lamp in accordance with a second embodiment of the disclosure.

A tubular mounting seat 19 is further provided to the LED lamp, for mounting the LED lamp to a lamp post (not shown) securely mounted at, for example, a roadside. The mounting seat 19 is fixed to a lateral plate and located at a top of a lateral side of the LED lamp. Referring to FIG. 5 also, in the second embodiment of this disclosure, a mounting seat 19*a* is fixed to the cover plate 124 and located at a top side of the LED lamp to be hung to a lamp pole.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED (light emitting diode) lamp comprising:

a planar base, wherein an annular receiving groove is recessed from a bottom face of the base;

an LED module attached on the bottom face of the base and surrounded by the receiving groove;

an envelope comprising a recessed body and an engaging flange extending outwardly from a periphery of the body, wherein the engaging flange is received in the receiving groove and the LED module is received between the recessed body and the base; and a lamp housing defining a cavity therein, wherein the base, the LED module and the envelope are received in the cavity;

wherein the lamp housing is hollowed-out and defines a plurality of windows through which light emitted by the LED module radiates out of the lamp; and wherein the lamp housing further comprises a plurality of transparent boards hermetically covering the windows, respectively.

2. The LED lamp as claimed in claim 1, wherein the engaging flange of the envelope has a dimension similar to that of the receiving groove.

3. The LED lamp as claimed in claim 1, wherein a bottom face of the engaging flange is coplanar with the bottom face of the base.

4. The LED lamp as claimed in claim 1 further comprising a pressing frame securing the envelope to the base.

5. The LED lamp as claimed in claim 4, wherein the pressing frame is loop-shaped, and the pressing frame is secured on the envelope and presses the engaging flange of the envelope towards the base.

6. The LED lamp as claimed in claim 4, wherein the engaging flange of the envelope is sandwiched between pressing frame and the base.

7. The LED lamp as claimed in claim 1, wherein the base cooperates with the envelope to define a receiving chamber for accommodating the LED module.

8. The LED lamp as claimed in claim 7 further comprising a waterproof connecter inserted into the base, the waterproof connector being configured for electrical wires extending therethrough to electrically connect with the LED module.

9. The LED lamp as claimed in claim 1, wherein the transparent boards are disposed in the cavity of the lamp housing.

10. The LED lamp as claimed in claim 1, wherein the lamp housing is cuboid-shaped.

11. The LED lamp as claimed in claim 1, wherein the LED module comprises a printed circuit board and a plurality of LEDs evenly mounted on the printed circuit board.

12. The LED lamp as claimed in claim 1, wherein the base is made by one of copper and aluminum.

13. The LED lamp as claimed in claim 1 further comprising a tubular mounting seat for mounting the LED lamp on a lamp pole, wherein the mounting seat is fixed to the lamp housing and located at a lateral side of the LED lamp.

14. The LED lamp as claimed in claim 1 further comprising a tubular mounting seat for mounting the LED lamp on a lamp pole, wherein the mounting seat is fixed to the lamp housing and located at a top side of the LED lamp.

15. The LED lamp as claimed in claim 1, wherein the lamp housing has a configuration of a lantern.

16. The LED lamp as claimed in claim 1 further comprising a driving module mounted on a top face of the base.

* * * * *